US011052302B2

(12) United States Patent
Lavallee et al.

(10) Patent No.: US 11,052,302 B2
(45) Date of Patent: Jul. 6, 2021

(54) LEG GUARD WITH ADJUSTABLE STRAP

(71) Applicant: SPORT MASKA INC., Montreal (CA)

(72) Inventors: Alexandre Lavallee, Ste-Anne-des-Lacs (CA); Jean-François Beland, Sainte-Thérèse (CA)

(73) Assignee: SPORT MASKA INC., Montreal (CA)

( * ) Notice: Subject to any disclaimer, the term of this patent is extended or adjusted under 35 U.S.C. 154(b) by 0 days.

(21) Appl. No.: 15/606,644

(22) Filed: May 26, 2017

(65) Prior Publication Data

US 2018/0339218 A1 Nov. 29, 2018

(51) Int. Cl.
*A63B 71/12* (2006.01)
*A41D 13/05* (2006.01)

(52) U.S. Cl.
CPC ..... *A63B 71/1225* (2013.01); *A41D 13/0562* (2013.01); *A41D 13/0568* (2013.01); *A63B 2071/1258* (2013.01)

(58) Field of Classification Search
CPC ..... A63B 71/1225; A63B 71/12; A63B 71/08; A63B 2071/1258; A63B 2071/1266; A63B 2071/1241; A63B 2071/125; A41D 13/0562; A41D 13/0568; A41D 13/0543; A41D 13/055; A41D 13/0556; A41D 13/0575; A41D 13/06; A41D 13/065; A41D 13/08
USPC ..... 2/22, 16, 24, 463, 457, 459
See application file for complete search history.

(56) References Cited

U.S. PATENT DOCUMENTS 4,366,813 A * 1/1983 Nelson ..... A61F 5/0109 2/24
4,654,893 A * 4/1987 Meyers ..... A63B 71/12 2/16
4,697,285 A * 10/1987 Sylvester ..... F41H 1/02 2/2.5
4,698,845 A 10/1987 Cosby
(Continued)

FOREIGN PATENT DOCUMENTS

CA 2670914 1/2011
DE 4031358 A1 * 4/1992 ..... A41D 13/0568
(Continued)

OTHER PUBLICATIONS

European Search Report for Application No. 18174489.7 dated Sep. 27, 2018.

*Primary Examiner* — Heather Mangine
(74) *Attorney, Agent, or Firm* — Norton Rose Fulbright Canada

(57) ABSTRACT

The leg guard for protecting at least a shin of a wearer includes a shin guard body and a strap. A peripheral edge of the shin guard body defines part of a perimeter of the shin guard body. The shin guard body includes a first coupling base and a second coupling base disposed on one of the interior and exterior surfaces. A first coupler is disposed at a first end of the strap and is releasably attachable to the first coupling base at a plurality of first attachment points, and a second coupler is disposed at the second end of the strap and is releasably attachable to the second coupling base at one of a plurality of second attachment points. A length of a wrappable segment is adjustable by releasably attaching the second coupler to the second coupling base at another one of the plurality of second attachment points.

16 Claims, 9 Drawing Sheets

(56) References Cited

U.S. PATENT DOCUMENTS 4,953,569 A * 9/1990 Lonardo ..... A61F 13/102 128/889
5,016,621 A * 5/1991 Bender ..... A61F 5/0109 2/22
5,187,812 A * 2/1993 Neuhalfen ..... A63B 71/12 2/267
5,220,691 A * 6/1993 Wiegers ..... A41D 13/065 2/2.5
5,343,562 A * 9/1994 Bible ..... A41D 13/081 2/158
5,456,658 A * 10/1995 Duback ..... A41D 13/0153 602/8
5,477,559 A * 12/1995 Clement ..... A63B 71/1225 2/22
5,544,663 A * 8/1996 Duback ..... A63B 71/1225 128/846
5,625,896 A * 5/1997 LaBarbera ..... A63B 71/1225 2/22
5,926,844 A * 7/1999 Bear ..... A63B 71/1225 2/22
6,029,273 A * 2/2000 McCrane ..... A41D 13/065 2/16
6,128,777 A * 10/2000 Foreman ..... A41D 13/08 128/878
6,134,720 A * 10/2000 Foreman ..... A63B 71/081 128/882
6,243,867 B1 * 6/2001 Faison ..... A41D 13/08 2/16
6,247,188 B1 * 6/2001 Beland ..... A63B 71/12 2/461
7,047,566 B2 * 5/2006 Beland ..... A63B 71/1225 2/22
2004/0154083 A1 * 8/2004 McVicker ..... A41D 13/05 2/455
2005/0120454 A1 * 6/2005 Cunningham ..... A41D 13/0568 2/24
2011/0010829 A1 * 1/2011 Norman ..... A41D 13/0512 2/459
2011/0289664 A1 12/2011 Udelhofen
2012/0022418 A1 * 1/2012 Gamboa ..... A61F 5/028 602/19
2012/0180205 A1 * 7/2012 Herring ..... A41D 13/0007 2/463
2012/0233750 A1 * 9/2012 Herbener ..... F41H 1/02 2/463
2013/0218105 A1 * 8/2013 Blumenfeld ..... A63B 71/1225 604/293
2014/0245528 A1 * 9/2014 Williams ..... A63B 71/12 2/461
2015/0216240 A1 * 8/2015 Martel ..... A41D 13/0568 2/455
2017/0160058 A1 * 6/2017 Limpisvasti ..... A41D 13/00

FOREIGN PATENT DOCUMENTS

DE 9307949 U1 * 10/1993 ..... A63B 71/1225
WO 2011091514 8/2011

* cited by examiner

LEG GUARD WITH ADJUSTABLE STRAP

TECHNICAL FIELD

The application relates generally to protective body wear and, more particularly, to leg guards such as those worn by participants of sporting events.

BACKGROUND OF THE ART

Personal protective equipment is commonly worn by participants (e.g. players) during sporting events, such as ice hockey (simply "hockey" herein) and soccer for example, to maintain the safety of the players. For sports such as soccer and hockey, a protective leg guard is commonly worn. Such leg guards include, for example, shin guards and shin pads that cover at least a portion of the lower leg, between the ankle and the knee, of the wearer. In the case of the equipment worn by hockey goaltenders, such leg guards may be much bigger and may cover a larger portion of the wearer's leg. Such leg guards are typically designed to protect a wearer's body from injury by reducing exposure of the covered body part, in this case the lower leg and shin, to impacts such as from a puck, a hockey stick, or a skate of another player. The wearer can secure the leg guard to the body with fasteners such as straps, harnesses, belts or tape. However, adequately adjusting the leg guard to the wearer's body size can be challenging.

SUMMARY OF THE INVENTION

There is accordingly provided a leg guard for protecting at least a shin of a wearer, the leg guard comprising: a shin guard body having an interior surface adapted to protect the shin of the wearer, and an opposite exterior surface, a peripheral edge of the shin guard body defining at least part of a perimeter of the shin guard body, the shin guard body including a first coupling base disposed on one of the interior and exterior surfaces of a first lateral side of the shin guard body, and a second coupling base disposed on one of the interior and exterior surfaces of a second lateral side of the shin guard body opposite the first lateral side; and a strap having opposed first and second ends and extending, in use, between the first and second lateral sides of the shin guard body, a first coupler disposed at the first end of the strap and being releasably attachable to the first coupling base at one of a plurality of first attachment points and a second coupler disposed at the second end of the strap and being releasably attachable to the second coupling base at one of a plurality of second attachment points, the strap defining an anchored segment and a wrappable segment upon the first and second couplers being attached to the first and second coupling bases, respectively, the anchored segment being defined between one of the plurality of second attachment points and the peripheral edge of the shin guard body, and the wrappable segment being defined between the peripheral edge and one of the plurality of first attachment points, a length of the wrappable segment being adjustable by releasably attaching the second coupler to the second coupling base at another one of the plurality of second attachment points.

In another aspect, there is further provided a method for mounting a leg guard to a leg of a wearer, the method comprising: placing a guard body of the leg guard on the leg; selecting one of a plurality of first attachment points on a first portion of the leg guard; releasably attaching a first end of a strap to the selected one of the plurality of first attachment points to select a length of a wrappable segment of the strap, the length of the wrappable segment being defined between a peripheral edge of the leg guard and a second end of the strap opposite to the first end; and wrapping the wrappable segment of the strap around the portion of the body and releasably attaching the second end of the strap to one of a plurality of second attachment points on a second portion of the leg guard.

BRIEF DESCRIPTION OF THE DRAWINGS

Reference is now made to the accompanying figures in which.

DETAILED DESCRIPTION

Figure 1:
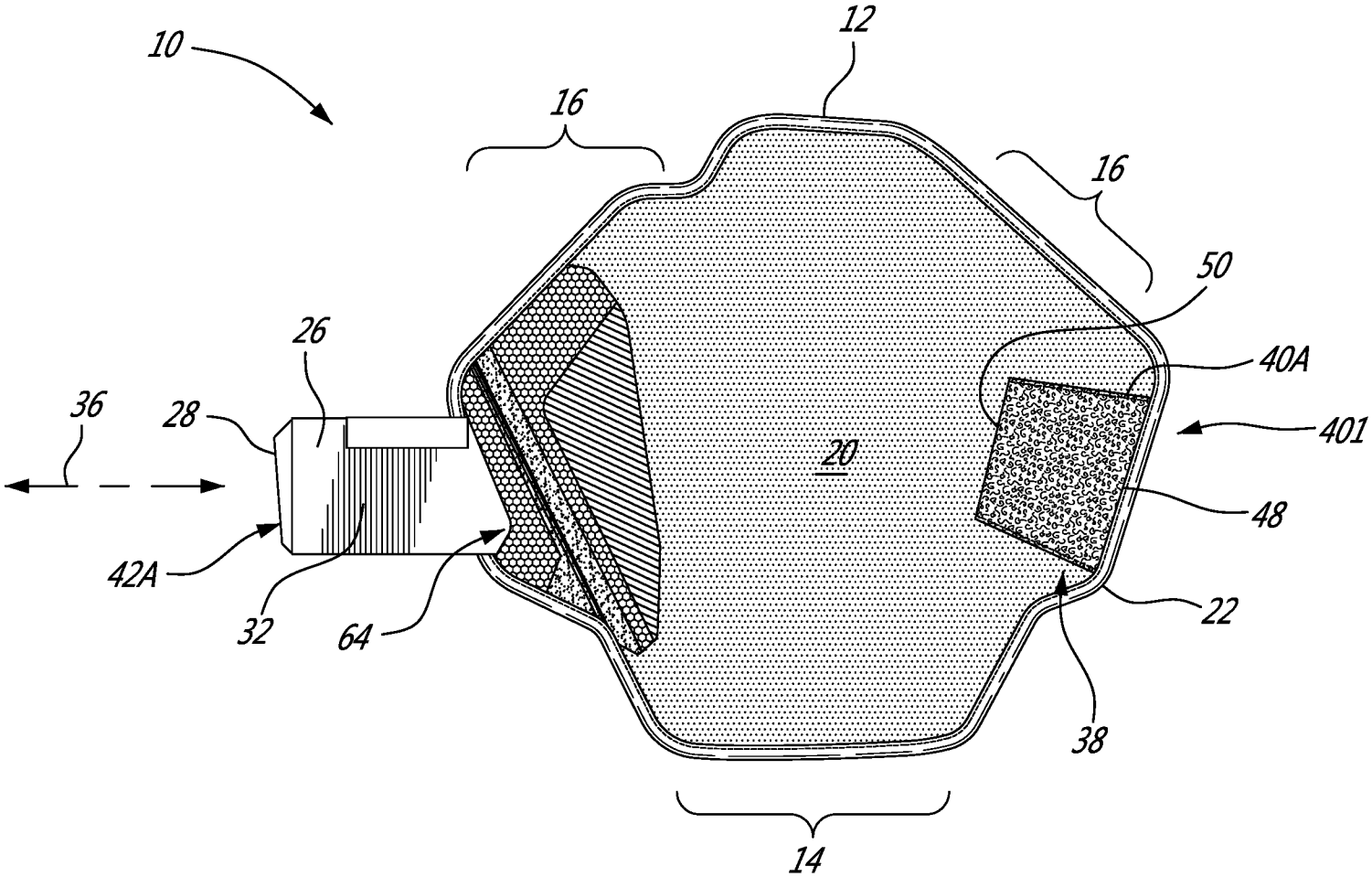
FIG. 1 is a schematic front view of a leg guard in accordance with a particular embodiment.
Figure 2:
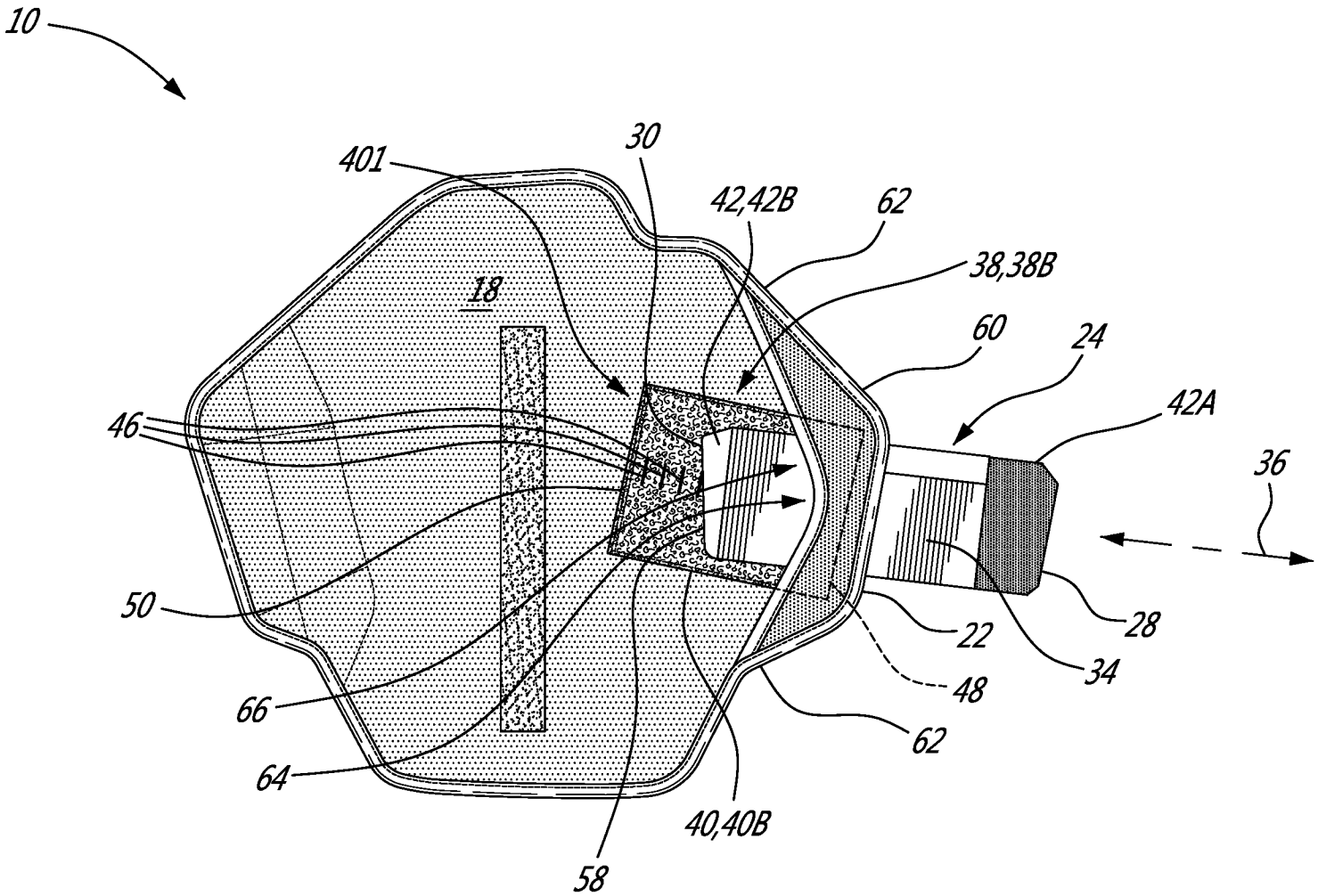
FIG. 2 is a schematic rear view of the leg guard shown in FIG. 1.

FIGS. 1 and 2 illustrate a leg guard 10 which can be used to protect at least a portion of a leg of a wearer in a sporting event, including but not limited to hockey (including ice, roller, field, floor, or deck hockey), soccer, football, baseball or lacrosse. In the embodiment shown, the leg guard 10 is adapted to protect a shin of the wearer. Therefore, the leg guard 10 may also be referred to as a "shin guard". The leg guard 10 is shaped and sized to fit over at least a shin of a leg of the wearer of the leg guard 10, in order to protect the shin from impacts and/or exposure to other hazards.

The leg guard 10 includes generally a shin guard body 12 and an adjustable strap 24, as will be described below. In this embodiment, and as shown in FIG. 2 with a strip extending vertically along a center of the shin guard body 12, the shin guard body 12 has a vertical center. As seen in FIG. 2, the vertical center divides the shin guard body 12 in two approximately equal halves: a left half and a right half, when viewed from an interior surface of the shin guard body 12. The shin guard body 12 is configured to cover and protect at least a portion of the shin of a wearer, but may also be larger such as to cover a greater portion of the wearer's leg that is to be protected. In the embodiment shown, the shin guard body 12 has a middle portion 14 and two side portions 16. The side portions 16 curve relative to the middle portion 14 to wrap around the portion of the body (e.g. the shin). The shin guard body 12 has the interior surface 18 adapted to contact the shin of the wearer and an opposite exterior surface 20 adapted to shield the shin from the hazards. In the depicted embodiment, the interior surface 18 is made from a soft material to provide added comfort to the wearer and the exterior surface 20 is made from a relatively rigid material to provide added protection to the portion of the body. The rigid material is selected to withstand an impact from a puck when the puck is shot towards the shin guard body 12.

The perimeter of the shin guard body is delimited by a peripheral edge 22. The interior and exterior surfaces 18,20 are joined at the peripheral edge 22. In the embodiment shown, the peripheral edge 22 delimits the shape of the shin guard body 12, which is selected to enhance the coverage and protection of the shin of the wearer. In other embodiments, the peripheral edge 22 is adapted to a different shape which corresponds to the shape of the portion of the body to be protected. For example, if it is desired to protect the forearm of the wearer, the peripheral edge 22 will delimit the shape of the shin guard body 12 to better cover the forearm.

The leg guard 10 also includes a strap 24 for mounting the shin guard body 12 to the portion of the body of the wearer. Still referring to FIGS. 1 and 2, the strap 24 has an elongated body 26 extending between two opposite ends 28,30. The strap 24 has an outer side 32 and an opposite inner side 34. In the depicted embodiment, the strap 24 is made from a resilient material. The resilient material permits the strap 24 to stretch in an adjustment direction 36 relative to the shin guard body 12, when a sufficient tension is applied in the adjustment direction 36. The adjustment direction 36 includes the direction along which the strap 24 expands under tension, and the direction opposite to this along which the strap 24 contracts when released from tension. The adjustment direction 36 is parallel to the longitudinal axis of the strap 24. The strap 24 can also include elastic webbing woven into the material between the two ends 28, 30.

The leg guard 10 includes two couplings 38 for releasably connecting the strap 24 to the shin guard body 12. Each coupling 38 includes a coupling base 40 and a coupler 42 which are releasably attachable to each other. In the embodiment shown, an exterior coupling base 40A is disposed at one end of the shin guard body 12 on the exterior surface 20 thereof. An interior coupling base 40B is disposed at an opposite end of the shin guard body 12 on the interior surface 18. A corresponding exterior coupler 42A is disposed at one end 28 of the strap 24 on the inner side 34 thereof and a corresponding interior coupler 42B is disposed at the other end 30 on the outer side 32. In an alternate embodiment, the coupling bases 40 are both disposed on one of the interior and exterior surfaces 18, 20. In another alternate embodiment, the coupling bases 40 are both disposed on opposite surfaces 18,20 of the shin guard body 12 to those described above. Similarly, the couplers 42 can be both disposed on one of the outer and inner sides 32,34 of the strap 24, or on opposite sides 32,34 to those described above.

Still referring to FIGS. 1 and 2, each coupler 42 is releasably attachable to a corresponding coupling base 40 and vice versa. In the embodiment shown, each of the couplings 38 has a hook and loop fastener 401. More particularly, the interior coupling base 40B and the exterior coupling base 40A have a plurality of hooks, and the corresponding interior and exterior couplers 42B,42A have a plurality of loops which engage the hooks of the interior and exterior coupling bases 40B,40A. The hook and loop fastener 401 can be made from VELCRO™. The position of the hooks and loops can be reversed. As can be seen in FIG. 2, in this embodiment the interior and exterior coupling bases 40B,40A are angled relative to the vertical center of the shin guard body 12. As can be further seen in FIG. 2, and also in FIG. 1, in this embodiment a portion of the exterior coupling base 40A extends parallel to a portion of a peripheral edge of the shin guard body 12 corresponding to the exterior coupling base 40A at a corresponding one of the lateral sides of the shin guard body 12. As can be further seen in FIG. 2, and also in FIG. 1, in this embodiment a portion of the interior coupling base 40B extends parallel to a portion of a peripheral edge of the shin guard body 12 corresponding to the interior coupling base 40B at the corresponding other one of the lateral sides of the shin guard body 12. As can be further seen in FIG. 2, and also in FIG. 1, in this embodiment the exterior coupling base 40A and the interior coupling base 40B are aligned with each other relative to the vertical center of the shin guard body 12. As can be further seen in FIG. 2, and also in FIG. 1, in this embodiment the exterior coupling base 40A and the interior coupling base 40B are angled relative to the vertical center of the shin guard body 12. Other configurations for attaching the coupler 42 and the coupling base 40 are also possible, as described in greater detail below. In other embodiments, other types of fasteners can also be used, including but not limited to, clamps, straps, hooks, clips, snaps, or buttons.

The interior coupling 38B, which includes the interior coupling base 40B and the interior coupler 42B, is elongated along the adjustment direction 36 and includes multiple attachment points 46 in order to attach the interior coupler 42B to the interior coupling base 40B at any one of the attachment points 46. In the depicted embodiment, the interior coupling base 40B occupies a portion of the interior surface 18 of the shin guard body 12. The extent of the interior coupling base 40B is delimited by two extremities 48,50 spaced apart from each other along the adjustment direction 36. In the depicted embodiment, the attachment points 46 are disposed on the interior coupling base 40B between the two extremities 48,50. It will therefore be appreciated that each attachment point 46 is a unique position on one or both of the coupling base 40 and/or the coupler 42 that allows the coupling base 40 to removably attach to a corresponding coupler 42 at said unique position. As will be explained in greater detail below, the removable attachment of a coupling base 40 to a corresponding coupler 42 at each attachment point 46 helps to define a usable length of the strap 24. In the embodiment of FIGS. 1 and 2, the interior coupling base 40B has a plurality of hooks which, when combined with the loops on the corresponding interior coupler 42B, form the hook and loop fastener 401 described above. In the depicted embodiment, each of the loops or a row of the loops of the interior coupling base 40B form an attachment point 46. In an alternate embodiment, the two spaced-apart extremities 48,50 and the plurality of attachment points 46 are provided only on the couplers 42 of the strap 24. Thus, the coupler 42B can be attached to the coupling base 40B at more than one of the attachment points 46 of the coupling base 40B. It is understood that there may be more than one attachment point 46 between the coupling base 40B and the coupler 42B. For example, when the hook and loop fastener 401 is used, a plurality of hooks and loops are simultaneously engaged, and the position at which the hooks and loops engage corresponds to one of the attachment points 46. In this embodiment, when the coupler 42B is attached to the coupling base 40B at more than one attachment point 46, an attachment position 58 of the strap 24 to the shin guard body 12 is defined along the adjustment direction 36. Although two couplings 38 have been shown, it is understood that any single or combination of couplings 38 can alternately be used to connect the strap 24 to the shin guard body 12.

Still referring back to FIGS. 1 and 2, the shin guard body 12 includes a strap guide portion 60 attached to the interior surface 18 of the shin guard body 12. The strap guide portion 60 is shown as an arm extending between two ends 62 which are connected to the interior surface 18 adjacent to the interior coupling base 40B. A remainder of the arm of the strap guide portion 60 is spaced from the interior surface 18 so as to define an elongated opening 64 between the ends 62 of the strap guide portion 60. The opening 64 forms a channel 66 between the strap guide portion 60 and the interior surface 18. The strap 24 is received through the channel 66. The strap guide portion 60 delimits the displacement of the strap 24 by guiding it through the channel 66 in the adjustment direction 36. The strap 24 can be guided such as to align the interior coupler 42B and the interior coupling base 40B for attachment. In an alternate embodiment, the shin guard body 12 includes one or more elongated openings defined through the interior and exterior surfaces 18, 20 to receive the strap 24.

Figure 3:
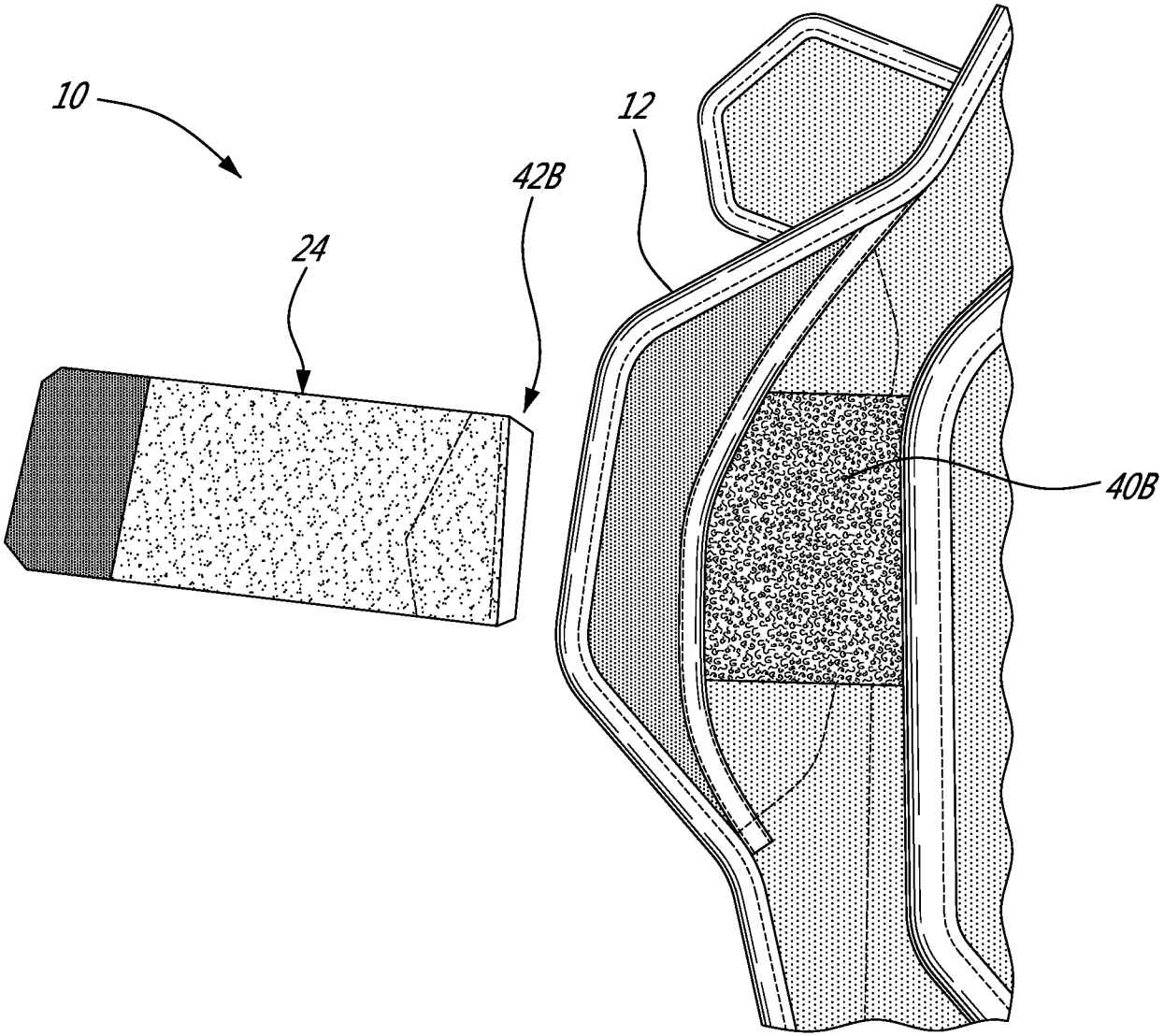
FIG. 3 is a view of the strap shown unattached from a shin guard body of the leg guard of FIG. 1.

Referring to FIG. 3, the strap 24 is shown disconnected and unattached from the shin guard body 12. In an embodiment, the strap 24 is provided or sold separately from the shin guard body 12.

Figure 4A:
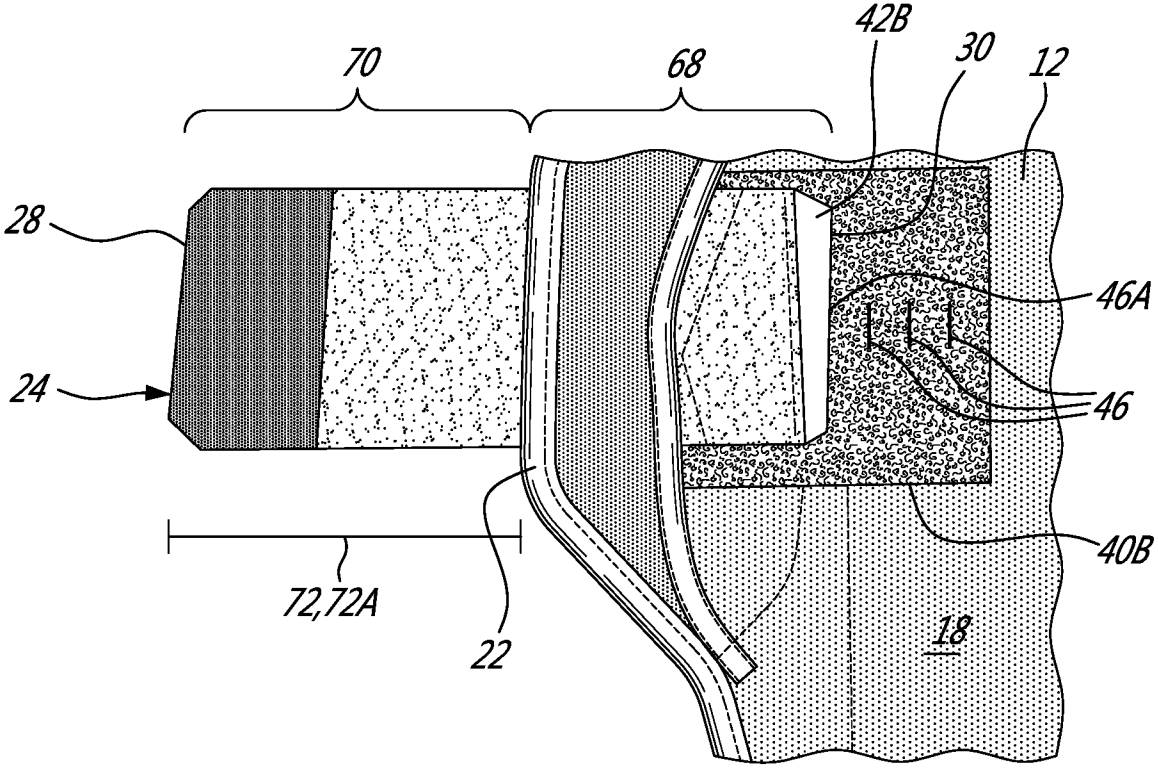
FIG. 4A is a schematic rear view of the leg guard of FIG. 1, showing a first length of a wrappable segment of the strap.
Figure 4B:
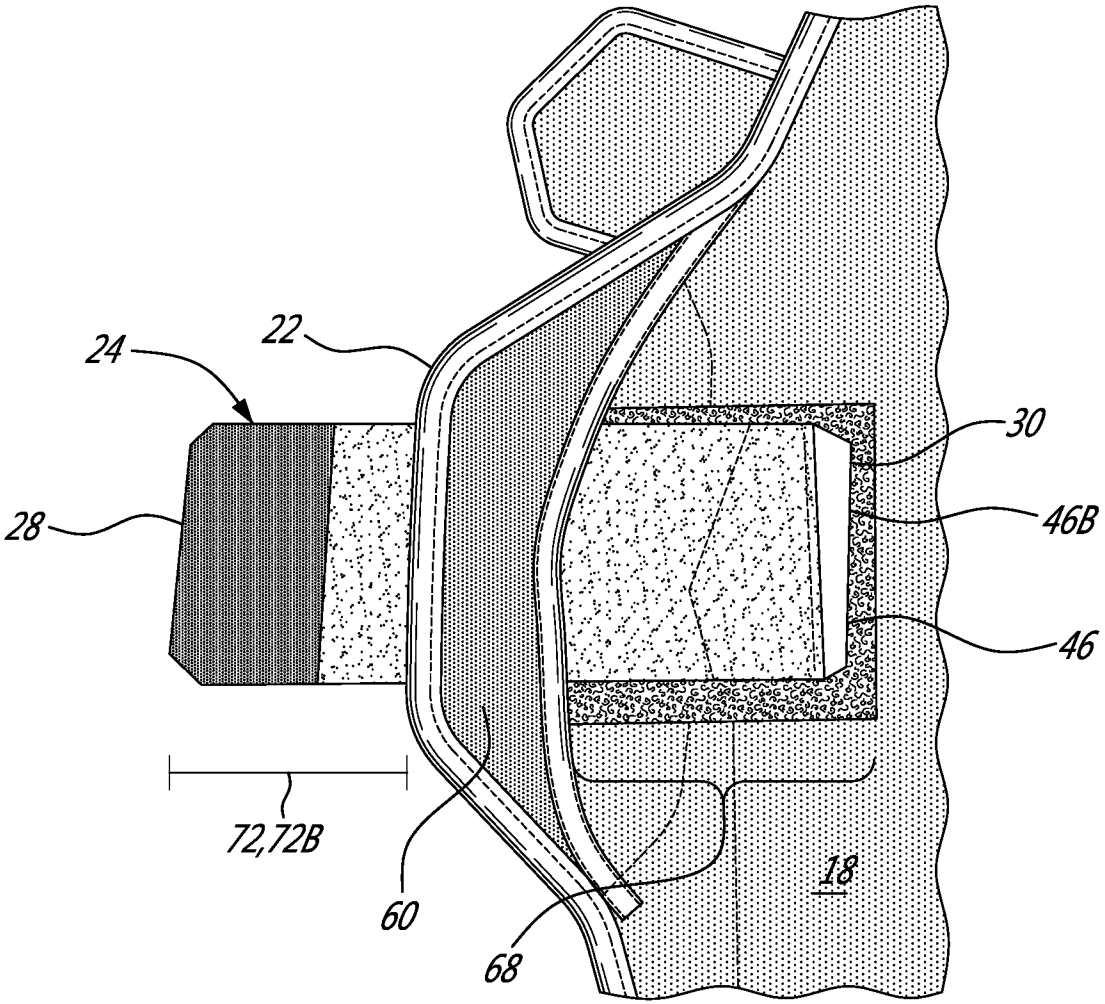
FIG. 4B is a schematic rear view of the leg guard of FIG. 1, showing a second length of the wrappable segment of the strap.
Figure 5A:
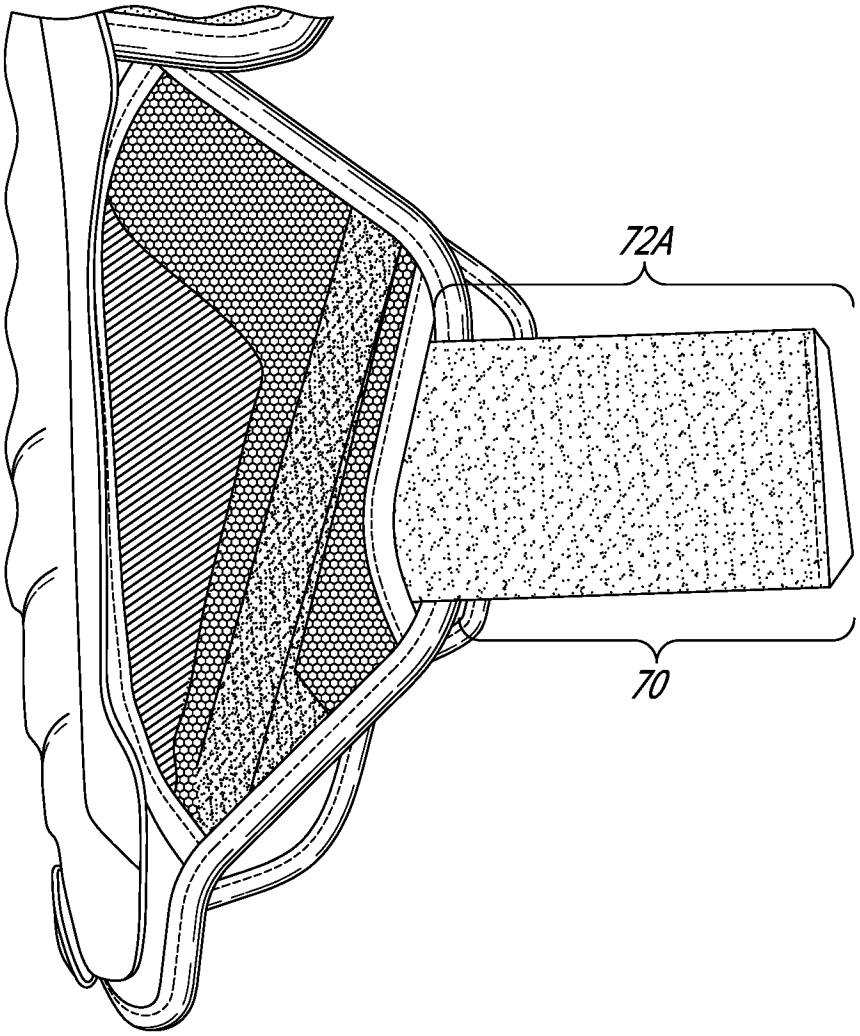
FIG. 5A is a schematic front view of the leg guard of FIG. 1, showing the first length of the wrappable segment of the strap.
Figure 5B:
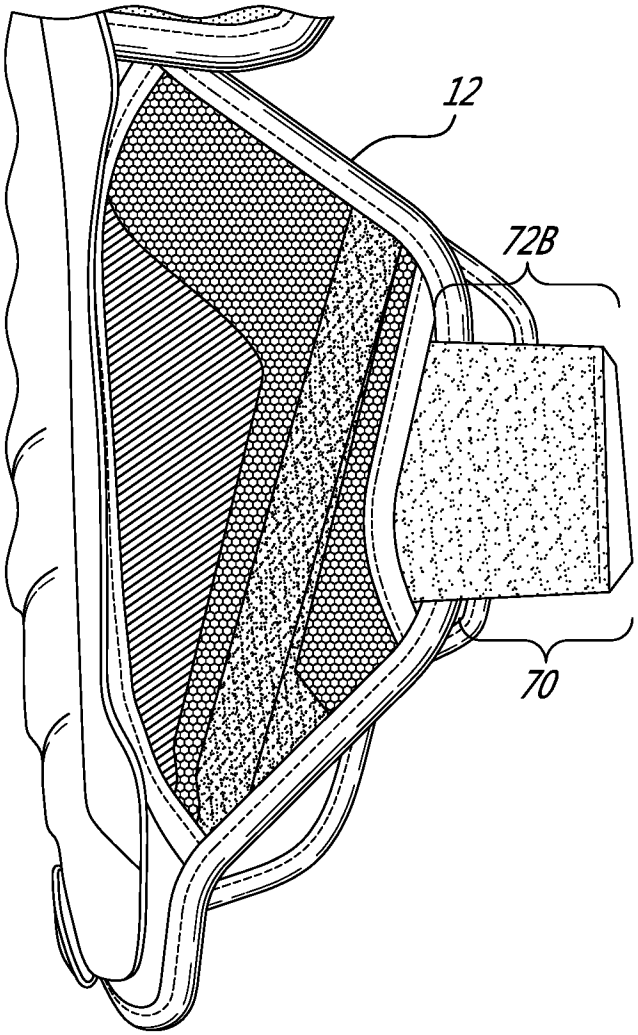
FIG. 5B is a schematic front view of the leg guard of FIG. 1, showing the second length of the wrappable segment of the strap.

Referring to FIGS. 4A to 5B, when the end 30 of the strap 24 is removably attached to the shin guard body 12, the strap 24 is divided into two segments of adjustable length. More particularly, when attached to the shin guard body 12, the strap 24 defines an anchored segment 68 and a wrappable segment 70. The anchored segment 68 is the portion of the strap 24 which, in the depicted embodiment, extends from its attachment point 46 on the interior coupling base 40B, along the interior surface 18 of the shin guard body 12, to the nearest portion of the peripheral edge 22 of the shin guard body 12. The anchored segment 68 is defined between the end 30 of the strap 24 and the edge 22 of the shin guard body 12. The wrappable segment 70 of the strap 24 is the "usable" portion of the strap 24. More particularly, the wrappable segment 70 is the portion of the strap 24 used to wrap around the portion of the body against which the shin guard body 12 is mounted. The wrappable segment 70 is defined between the peripheral edge 22 of the shin guard body 12 and the opposite end 28 of the strap 24. The wrappable segment 70 has an adjustable length 72. The adjustable length 72 is varied by releasably attaching the interior coupler 42B to a different attachment point 46 on the interior coupling base 40B. This is more clearly understood by comparing FIGS. 4A and 4B. In FIG. 4A, the wrappable segment 70 has a first length 72A defined between the peripheral edge 22 of the shin guard body 12 and the opposite end 28 of the strap 24. The first length 72A of the wrappable segment 70 is obtained by releasably attaching the interior coupler 42B to a first attachment point 46A on the interior coupling base 40B. In FIG. 4B, the wrappable segment 70 has a second length 72B that is shorter than the length 72A shown in FIG. 4A. The second length 72B is obtained by attaching the interior coupler 42B to a second attachment point 46B which is further inward from the peripheral edge 22 of the shin guard body 12. It will therefore be appreciated that by changing the point 46 at which the strap 24 attaches to the shin guard body 12, the usable (i.e. wrappable) length of the strap 24 can be adjusted. The strap 24 disclosed herein can therefore be used to mount the shin guard body 12 to many different sizes of the portion of the body needing protection. It will be appreciated that adjusting the length 72 of the wrappable segment 70 also adjusts the length of the anchored segment 68. More particularly, the length 72 of the wrappable segment 70 is inversely proportional to the length of the anchored segment 68, such that when the length 72 of the wrappable segment 70 is increased, the length of the anchored segment 68 will decrease. FIGS. 5A and 5B illustrate the wrappable segment 70 as seen from the other side of FIGS. 4A and 4B.

In the embodiment shown in FIG. 4B, the strap guide portion 60 helps to retain the anchored segment 68 on the interior surface 18. More particularly, the guide portion 60 allows the wrappable segment 70 to wrap around the peripheral edge 22 of the guide body 12 without separating or pulling apart at least a portion of the anchored segment 68 from the interior surface 18 of the guide body 12. The strap guide portion 60 therefore helps to restrain the anchored segment 68 from completely separating away from the interior surface 18, for example, when a pulling force is applied on the wrappable segment 70 in a direction out of the plane of the page of FIG. 4B.

Referring to FIGS. 1 and 2, there is also disclosed herein a method for mounting a leg guard 10 about a portion of a body. The method includes placing the leg guard 10 on the portion of the body, releasably attaching the end 30 of the strap 24 to one of a plurality of attachment points 46 on the interior coupling base 40B to select the length 72 of the wrappable segment 70 of the strap 24, wrapping the wrappable segment 70 around the portion of the body and releasably attaching the end 28 of the strap 24 to the exterior coupling base 40A.

In use, the interior coupler 42B of the strap 24 is attached to the interior coupling base 40B of the shin guard body 12 at one of the attachment points 46 to adjust and/or select the length 72 of the wrappable segment 70 of the strap 24. The shin guard body 12 is then placed on the portion of the body to shield the portion of the body from hazards. Once the shin guard body 12 is placed on the portion of the body, the wrappable segment 70 is wrapped around the portion of the body and the exterior coupler 42A is attached to the exterior coupler base 40A. Advantageously, the length 72 of the wrappable portion 70 can be adjusted by selecting another attachment point 46.

Figure 6:
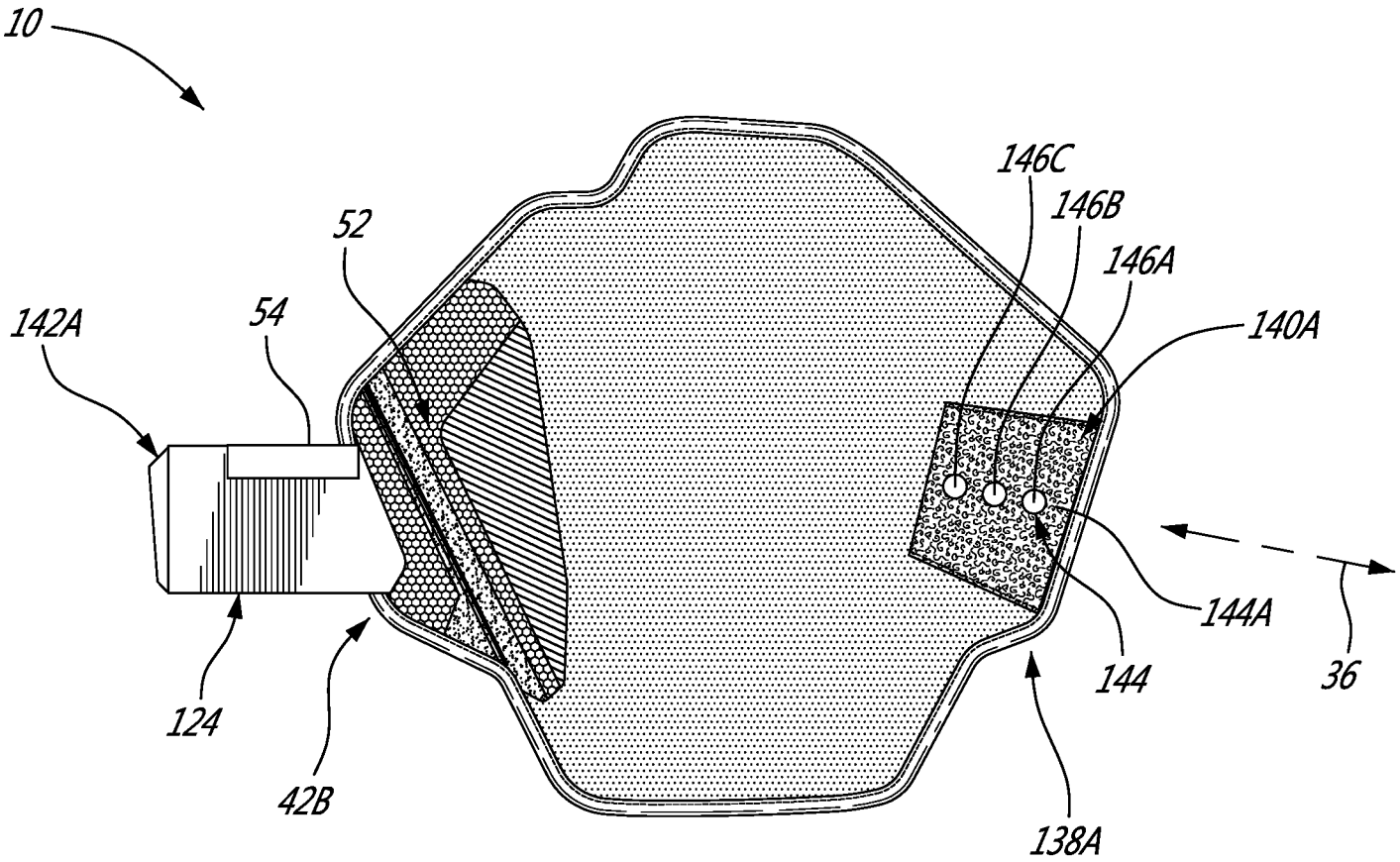
FIG. 6 is a schematic front view of a leg guard in accordance with another embodiment.
Figure 7:
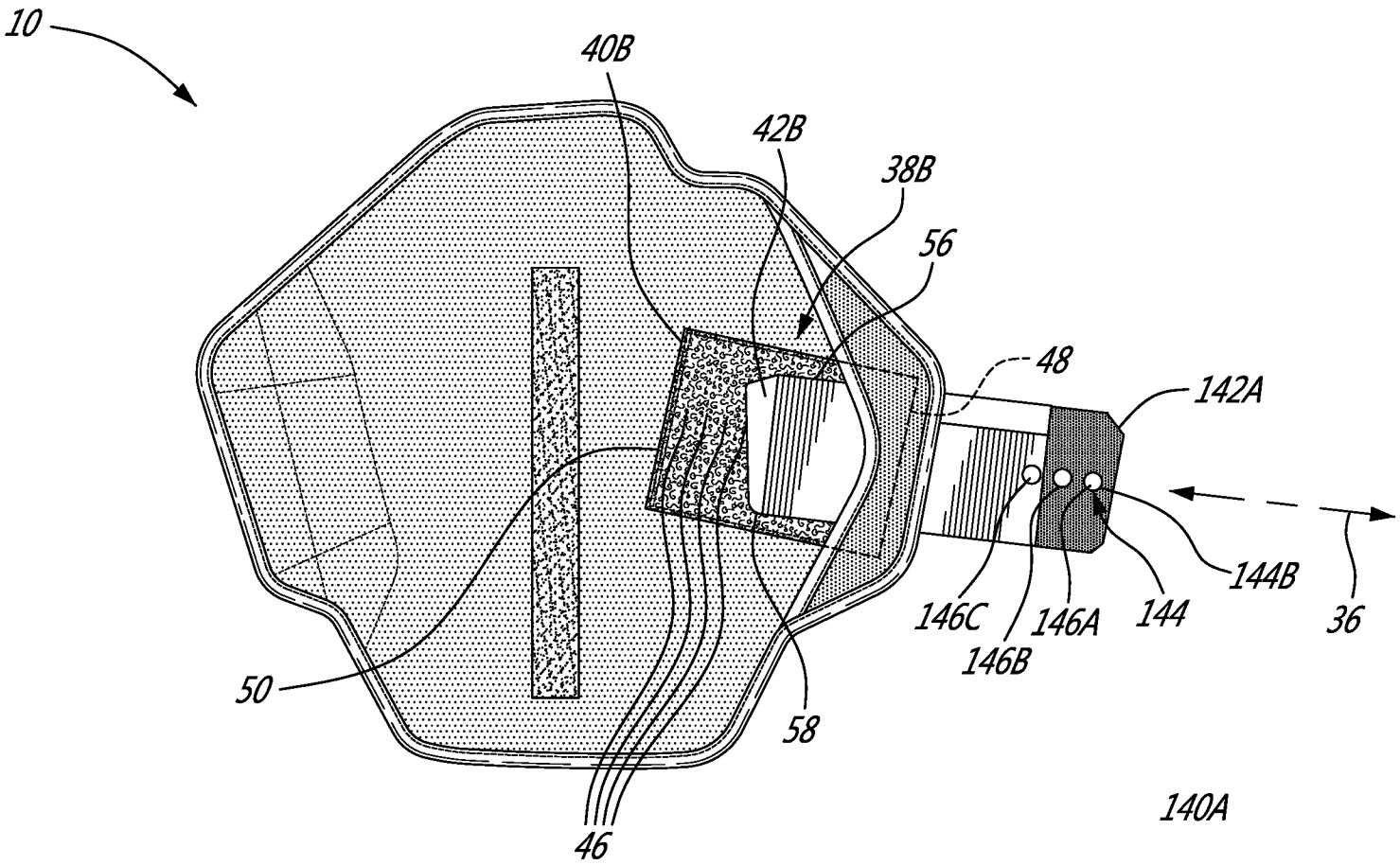
FIG. 7 is a schematic rear view of the leg guard of FIG. 6.

Referring to the embodiment shown in FIGS. 6 and 7, the exterior coupling 138A has press studs 144 which are disposed on, and extend from, the exterior coupling base 140A in the illustrated embodiment. The press studs 144 extend in the adjustment direction 36 to provide three discrete attachment points 146A, 146B, 146C. Each press stud 144 has a male member 144A on the exterior coupling base 140A which mates with a corresponding female member 144B on the exterior coupler 142A of the strap 124. In an alternate embodiment, the pair of the coupling base 40 and coupler 42 include clamps, straps, hooks, clips, snaps, buttons or any other suitable mechanism for releasably attaching the coupler 42 and coupling base 40 together.

Although the adjustable attachment of the interior coupler 42A to the interior coupling base 40A is described herein, it will be appreciated that the exterior coupler 42B is attachable to the exterior coupling base 40B in a similar manner. It will therefore be appreciated that by changing the attachment point 46 between the exterior coupler 42B and the exterior coupling base 40B, the usable (i.e. wrappable) length of the strap 24 can be adjusted. Moreover, in a particular embodiment, the resilient strap 24 can also be stretched to offer a better fit between the shin guard body 12 and the portion of the body.

The descriptors "first" and "second" are used herein to distinguish portions of the strap 24 and of the shin guard body 12. It will be appreciated that the descriptors "first" and "second" can be inversed without affecting the scope of the present disclosure.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A protective shin guard for a shin of a leg of a hockey player, comprising:

a body having a first lateral side and a second lateral side opposed to the first lateral side, a wearer-facing surface extending between the first lateral side and the second lateral side, the wearer-facing surface shaped to conform to the shin of the hockey player, and an exterior surface opposite the wearer-facing surface;

an exterior coupling base on the exterior surface proximate the first lateral side;

an interior coupling base on the wearer-facing surface proximate the second lateral side;

a strap guide portion connected to the wearer-facing surface of the body at the second lateral side, a first section of the strap guide portion overlapping the interior coupling base, and a channel defined between the wearer-facing surface and the strap guide portion; and a strap having an exterior coupler at a first end of the strap and an interior coupler at a second end of the strap, the exterior coupler releasably attachable to the exterior coupling base, the interior coupler releasably attachable to the interior coupling base, wherein the strap extends from the interior coupling base at the wearer-facing surface, through the channel thereby extending over a surface of the strap guide portion, the strap exiting the channel and wrapping around an edge of the strap guide portion and configured to wrap around the leg of the hockey player to reach the exterior coupling base.

2. The protective shin guard of claim 1, wherein ast least a part of the interior coupling base is disposed between the strap guide portion and the wearer-facing surface.

3. The protective shin guard of claim 1, wherein the exterior coupling base is angled relative to a vertical center of the body.

4. The protective shin guard of claim 3, wherein the interior coupling base is angled relative to the vertical center of the body.

5. The protective shin guard of claim 4, wherein a portion of the exterior coupling base extends parallel to a corresponding portion of a peripheral edge of the body at the first lateral side.

6. The protective shin guard of claim 5, wherein a portion of the interior coupling base extends parallel to the corresponding portion of the peripheral edge of the body at the second lateral side.

7. The protective shin guard of claim 1, wherein a portion of the exterior coupling base extends parallel to a corresponding portion of a peripheral edge of the body at the first lateral side.

8. The protective shin guard of claim 1, wherein a portion of the interior coupling base extends parallel to a corresponding portion of a peripheral edge of the body at the second lateral side.

9. The protective shin guard of claim 1, wherein the exterior coupling base is sized relative to the exterior coupler to provide a plurality of exterior attachment points for the exterior coupler on the exterior coupling base, the exterior coupler being releasably attached to the exterior coupling base at a given exterior attachment point of the plurality of exterior attachment points.

10. The protective shin guard of claim 9, wherein the exterior coupling base includes one of a hook fastener and a loop fastener and the exterior coupler includes another one of the hook fastener and the loop fastener.

11. The protective shin guard of claim 1, wherein the interior coupling base is sized relative to the interior coupler to provide a plurality of interior attachment points for the interior coupler on the interior coupling base, the interior coupler being releasably attached to the interior coupling base at a given interior attachment point of the plurality of interior attachment points.

12. The protective shin guard of claim 11, wherein the interior coupling base includes one of a hook fastener and a loop fastener and the interior coupler includes another one of the hook fastener and the loop fastener.

13. The protective shin guard of claim 1, wherein the strap is composed of a resilient material.

14. The protective shin guard of claim 1, wherein the strap includes elastic webbing extending between the exterior coupler and the interior coupler.

15. The protective shin guard of claim 1, wherein the interior coupling base is positioned relative to the body and the strap guide portion such that when the protective shin guard is worn on the shin, the interior coupling base is disposed between the wearer-facing surface and the leg of the hockey player.

16. The protective shin guard of claim 1, wherein:

the strap has a first surface and a second surface opposite the first surface;

the exterior coupler is on the first surface; and the interior coupler is on the second surface.

* * * * *